US009308656B2

(12) United States Patent
Wevers et al.

(10) Patent No.: US 9,308,656 B2
(45) Date of Patent: Apr. 12, 2016

(54) APPARATUS COMPRISING ROTATABLE MEMBER

(75) Inventors: Dirk Hendrik Wevers, Drachten (NL); Reinier Alexander Tijssen, Zwolle (NL); Ishay Halmut, Groningen (NL)

(73) Assignee: KONINKLIJKE PHILIPS N.V., Eindhoven (NI)

( * ) Notice: Subject to any disclaimer, the term of this patent is extended or adjusted under 35 U.S.C. 154(b) by 400 days.

(21) Appl. No.: 13/509,697

(22) PCT Filed: Dec. 7, 2010

(86) PCT No.: PCT/IB2010/055621
§ 371 (c)(1),
(2), (4) Date: May 14, 2012

(87) PCT Pub. No.: WO2011/073850
PCT Pub. Date: Jun. 23, 2011

(65) Prior Publication Data

US 2013/0239416 A1 Sep. 19, 2013

(30) Foreign Application Priority Data

Dec. 14, 2009 (EP) ..... 09179008

(51) Int. Cl.
*B26B 19/20* (2006.01)
*B26B 19/06* (2006.01)

(52) U.S. Cl.
CPC ..... *B26B 19/205* (2013.01); *B26B 19/06* (2013.01); *B26B 19/20* (2013.01)

(58) Field of Classification Search
CPC ..... B26B 19/20; B26B 19/06; B26B 19/02; B23B 19/00; F16H 25/18; F16H 31/004; F16H 31/002
USPC ..... 30/200, 201, 233.5, 233, 132, 60, 61, 30/63, 71, 79, 80; 74/462, 63, 111
See application file for complete search history.

(56) References Cited

U.S. PATENT DOCUMENTS

| | | | | |
|---|---|---|---|---|
| 3,263,328 | A * | 8/1966 | Craig | 30/63 |
| 3,709,055 | A * | 1/1973 | Grove | 74/462 |
| 4,845,852 | A | 7/1989 | Sukow | |
| 5,367,772 | A | 11/1994 | Ogawa | |
| 7,234,242 | B2 | 6/2007 | Yao | |
| 2005/0246902 | A1 | 11/2005 | Poran | |
| 2006/0107529 | A1 | 5/2006 | Kostner et al. | |
| 2010/0083508 | A1 * | 4/2010 | Cheng | 30/201 |

FOREIGN PATENT DOCUMENTS

| | | | |
|---|---|---|---|
| DE | 1090544 | B | 10/1960 |
| DE | 102004031378 | A1 * | 1/2006 |
| EP | 0325326 | A1 | 7/1989 |
| EP | 2610039 | A1 * | 7/2013 |
| KR | 20010047005 | A | 11/2001 |
| WO | 2007004204 | A1 | 1/2007 |

* cited by examiner

*Primary Examiner* — Kenneth E. Peterson
*Assistant Examiner* — Jennifer Swinney

(57) ABSTRACT

An apparatus for adjusting a distance between first and second elements, comprising a first rotation member (200) rotatable between first and second stop positions and a second rotation member (300), wherein rotation of the first member between the first and second stop positions comprises a first rotation stage in which the first rotation member rotates through a first rotation angle and a second rotation stage in which the first rotation member is configured to engage with the second rotation member to rotate the second rotation member through a second rotation angle.

15 Claims, 5 Drawing Sheets

APPARATUS COMPRISING ROTATABLE MEMBER

FIELD OF THE INVENTION

The invention relates to a member rotatable between first and second stop positions.

BACKGROUND TO THE INVENTION

Electrically powered grooming devices such as hair clippers and beard trimmers are often operable to cut hair at a plurality of different lengths. The desired length can be selected by rotating an adjustment wheel on the body of the grooming device to adjust the distance between a cutting element and a comb attachment. The adjustment wheel is generally rotatable between two end positions, which respectively correspond to the maximum and minimum cutting lengths of the grooming device.

The end positions can correspond to positions at which a pin attached to the wheel abuts against a fixed pin in the body of the grooming device. However, this limits the maximum rotation angle of the wheel to less than 360 degrees. Therefore, fine adjustment of the cutting length is made difficult because a relatively small movement of the adjustment wheel can correspond to a relatively large change in the distance between the cutting element and comb attachment.

SUMMARY OF THE INVENTION

According to the invention, there is provided an apparatus for adjusting a distance between first and second elements, comprising a first rotation member rotatable between first and second stop positions and a second rotation member, wherein rotation of the first member between the first and second stop positions comprises a first rotation stage in which the first rotation member rotates through a first rotation angle and a second rotation stage in which the first rotation member is configured to engage with the second rotation member to rotate the second rotation member through a second rotation angle.

The first and second rotation members may be axially aligned.

The first rotation member may comprise an axially extending projection configured to abut an axially extending projection of the second rotation member to engage the first rotation member with the second rotation member.

The axially extending projection of the first rotation member may be configured to extend into an arcuate recess of the second rotation member along which the axially extending projection of the first rotation member may be configured to move during the first rotation stage.

The apparatus may further comprise a third member configured to engage with the second rotation member upon the second rotation member being rotated through the second rotation angle to prevent further rotation of the first and second rotation members.

The third member may comprise an end stop, which may comprise an axially extending projection configured to abut a second axially extending projection of the second rotation member to engage the third member with the second rotation member to prevent further rotation of the first and second rotation members.

The second axially extending projection of the second rotation member may be configured to extend into an arcuate recess of the third member along which it may be configured to move during the first rotation stage.

The first rotation member may comprise an outer grip for rotating the first rotation member in the first and second rotation stages.

The rotation angle of the first rotation member between the first and second stop positions may exceed 360 degrees.

The first rotation member may be configured to drive a movement in the position of the first element with respect to the position of the second element when rotated between the first stop position and the second stop position.

The first element may comprise one of a comb attachment and a hair cutting element, and the second element may comprise the other of the comb attachment and hair cutting element.

According to the invention, there may also be provided a grooming device comprising the apparatus.

The first stop position may correspond to a minimum hair cutting length setting and the second stop position may correspond to a maximum hair cutting length setting.

According to the invention, there is provided a method of adjusting a distance between first and second elements, comprising rotating a first rotation member from a first stop position through a first rotation angle, engaging the first rotation member with a second rotation member, and further rotating the first rotation member through a second rotation angle to the second stop position, the engagement between the first rotation member and the second rotation member causing the second rotation member to rotate through the second rotation angle.

The second rotation member may engage with a third member upon being rotated through the second rotation angle, the engagement between the second rotation member and the third member preventing further rotation of the first and second rotation members.

It is to be noted that published US patent application US 2005/0246902 A1 discloses a hair clipper having an adjustment mechanism comprising a control ring which, on being rotated by a user, causes a rotation of a threaded screw, and thereby displacement of a longitudinal positioner along a longitudinal axis of the clipper. The control ring of US 2005/0246902 A1 is disclosed to be rotatable over an angle exceeding 360 degrees. Stops limiting the movement of the longitudinal positioner are provided, restricting the longitudinal movement of the longitudinal positioner rather than rotation of the control ring.

BRIEF DESCRIPTION OF THE DRAWINGS

Embodiments of the invention will now be described by way of example only with reference to the accompanying figures, in which.

DETAILED DESCRIPTION OF EMBODIMENTS

Figure 1:
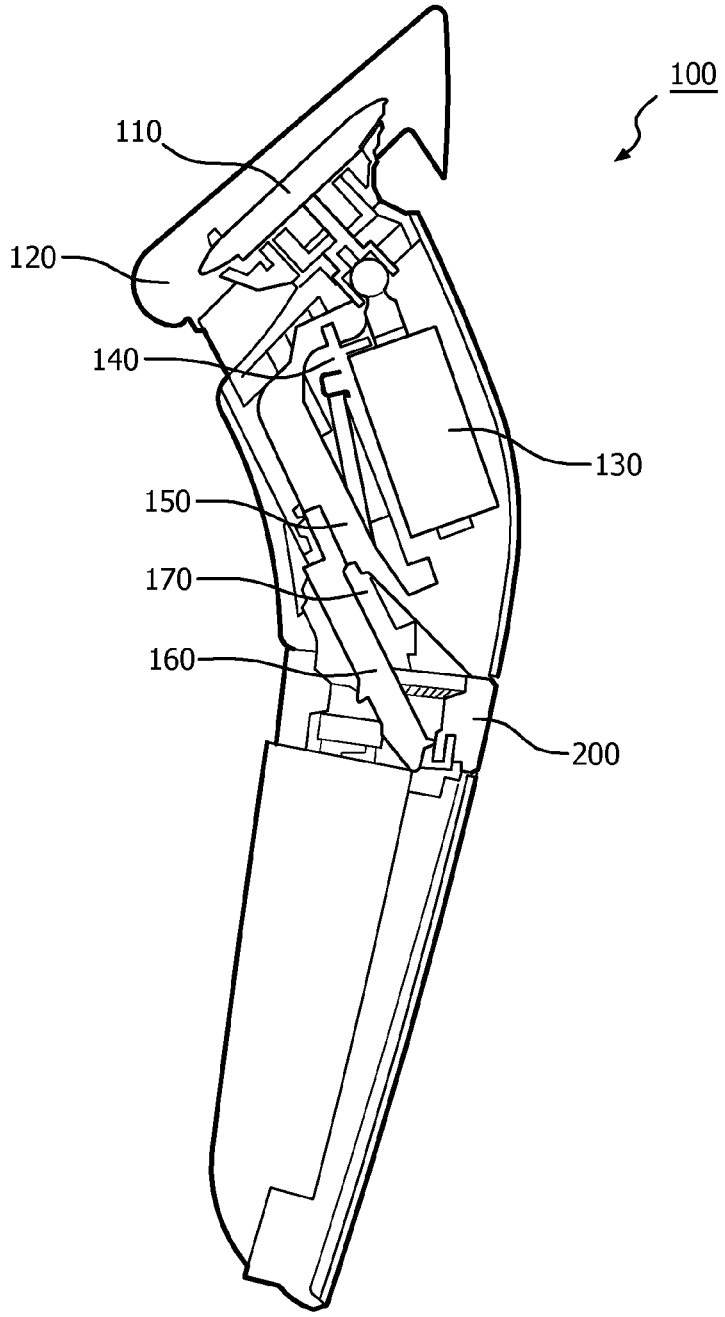
FIG. 1 is an illustration of a grooming device comprising a hair cutting element and a comb attachment moveable with respect to the hair cutting element.

An apparatus for adjusting the distance between a hair cutting element 110 and a comb attachment 120 in a grooming device 100 is shown in FIGS. 1 to 5. As can be seen from FIG. 1, the grooming device 100 may comprise a motor 130 for driving the cutting element 110. The motor 130 is supported in a motor housing 140, which is attached to a sub frame 150 of the grooming device 100. A spindle 160 comprising a helical gear is configured to move longitudinally with respect to a spindle wheel 170 upon being rotated. Longitudinal movement of the spindle 160 is configured to vary the distance between the cutting element 110 and the comb attachment 120.

The apparatus comprises a first rotation member 200, which can be rotated to set the distance between the cutting element 110 and the comb attachment 120 by cooperation with the spindle 160. The first rotation member 200 may therefore be referred to as an adjustment wheel of the grooming device 100. The first rotation member 200 is rotatable through a predetermined rotation angle between first and second stop positions, which may respectively correspond to a maximum and a minimum distance between the hair cutting element 110 and the comb attachment 120. As will be described below, the first rotation member 200 cooperates with a second rotation member 300 and a third member 400 when rotating between the first and second stop positions.

Figure 2A:
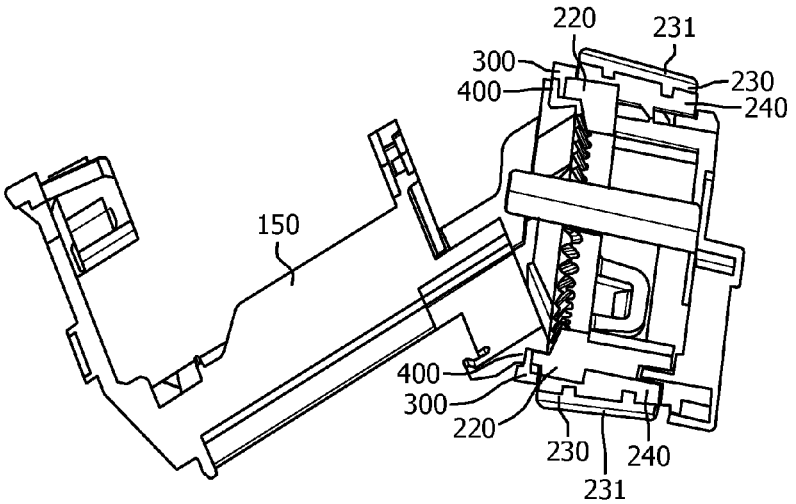
FIG. 2A is a cross sectional view of an apparatus for adjusting a distance between the hair cutting element and the comb attachment in the grooming device shown in FIG. 1.
Figure 2B:
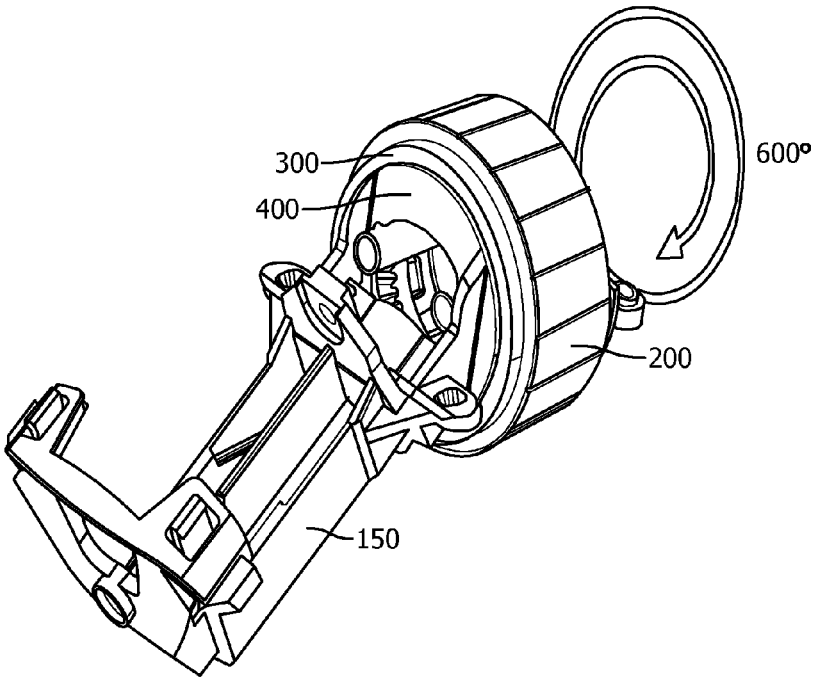
FIG. 2B is a perspective view of the apparatus shown in FIG. 2A.

Referring to FIGS. 2A and 2B, the first rotation member 200 may be axially aligned with the second rotation member 300 such that the first 200 and second 300 rotation members are rotatable about the same axis. The first 200 and second 300 rotation members may also be axially aligned with the third member 400, which is fixed with respect to the rotation axis of the first and second members 200, 300. The first rotation member 200 is configured to cooperate with the second and third members 300, 400 such that the first and second stop positions of the first rotation member 200 can be spaced by a rotation angle exceeding 360 degrees. As such, the first rotation member 200 can be used for fine adjustment of the distance between the cutting element 110 and the comb attachment 120 of the grooming device 100.

Figure 3:
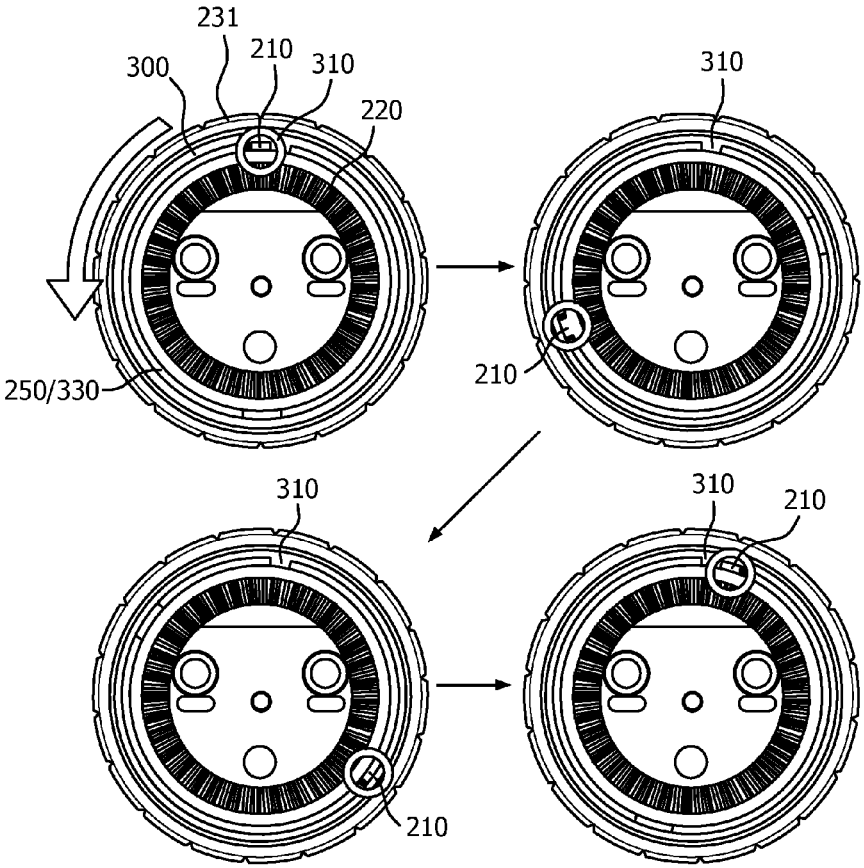
FIG. 3 is a sequence of cross sectional illustrations showing a first rotation stage of a first rotation member in the apparatus illustrated in FIGS. 2A and 2B. The sequence comprises rotation of the first rotation member between a first stop position and engagement with a first radial surface of a second rotation member.
Figure 4A:
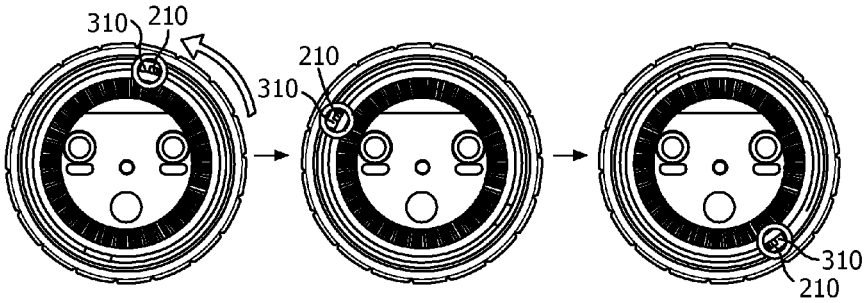
FIG. 4A is a sequence of illustrations showing a second rotation stage of the first rotation member in the apparatus illustrated in FIGS. 2A and 2B. The sequence comprises rotation of the first rotation member and the first radial surface of the second rotation member between engagement of the first and second rotation members and a second stop position of the first rotation member.
Figure 4B:
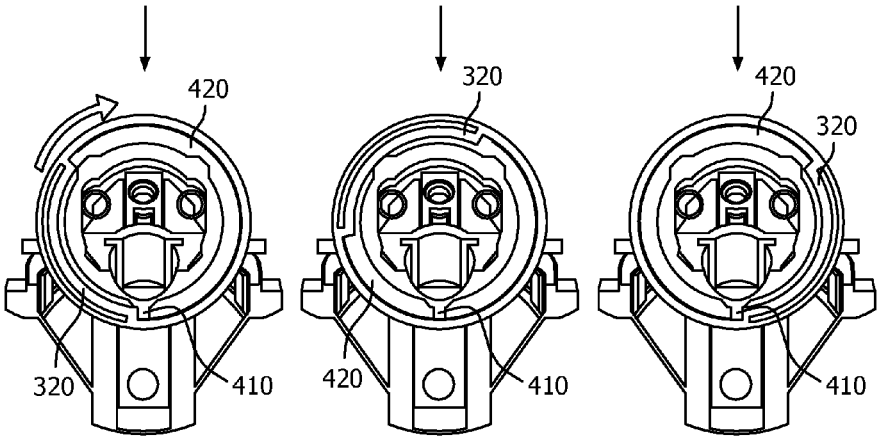
FIG. 4B is a sequence of illustrations showing rotation of a second radial surface of the second rotation member with respect to an end stop during the second rotation stage of the first rotation member shown in FIG. 4A.
Figure 6:
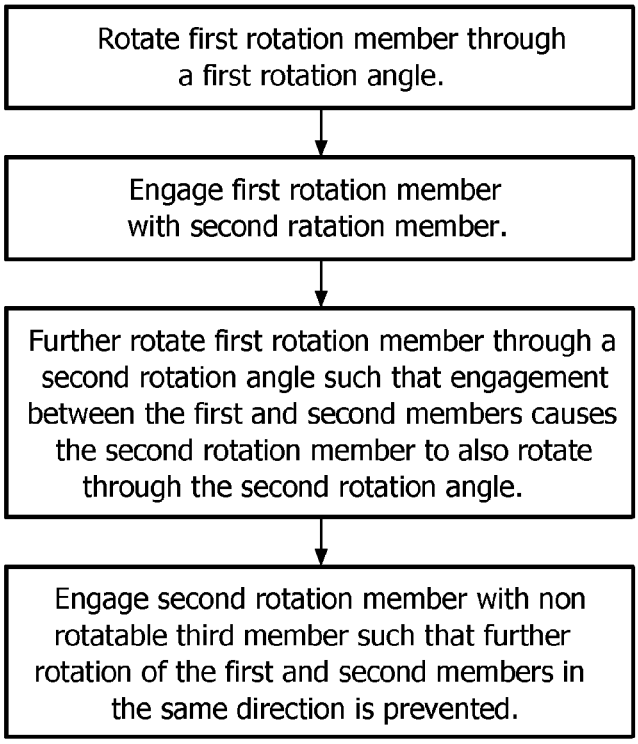
FIG. 6 is a flow diagram illustrating a method of adjusting a distance between a hair cutting element and a comb attachment in a grooming device.

An overview of a rotation of the first rotation member 200 between the first and second stop positions will now be described in terms of two separate rotation stages, which are shown in FIGS. 3, 4A and 4B and described in FIG. 6. FIG. 3 illustrates the first rotation stage. FIGS. 4A and 4B illustrate the second rotation stage. The overview will be followed by a detailed description of the individual members 200, 300, 400.

In a first rotation stage, illustrated in FIG. 3, starting from the first stop position the first rotation member 200 can rotate with respect to the second rotation member 300 and the third member 400 through a first predetermined rotation angle. Upon rotating through the first predetermined rotation angle, the first rotation member 200 is configured to engage with the second rotation member 300. As shown in FIG. 3, engagement of the first and second rotation members 200, 300 may be caused by a projection 210 of the first rotation member 200 abutting a first projection 310 of the second rotation member 300.

In the second rotation stage, illustrated in FIGS. 4A and 4B, following engagement of the first and second rotation members 200, 300 the first and second rotation members 200, 300 can rotate together through a second predetermined rotation angle. Upon rotating through the second predetermined rotation angle, the second rotation member 300 is configured to engage with the third member 400. As shown in FIG. 4B, engagement of the second and third members 300, 400 may be caused by a second projection 320 on a rear face of the second rotation member 300 abutting a projection 410 of the third member 400.

The third member 400 is not rotatable, and therefore further rotation of the first and second rotation members 200, 300 in the same direction is prevented. The position at which the second rotation member 300 engages with the third member 400 corresponds to the second stop position of the first rotation member 200.

Starting from the second stop position, the first rotation member 200 can rotate in an opposite direction back to the first stop position in a manner which reflects the rotation described above. Specifically, the first rotation member 200 can rotate back through the first predetermined rotation angle before engaging again with the second rotation member 300 and driving a rotation of the second rotation member 300 back through the second predetermined rotation angle. Upon being rotated back through the second predetermined rotation angle the second rotation member 300 engages again with the third member 400, the fixed nature of which prevents further rotation of the first and second rotation members 200, 300. Re-engagement between the second rotation member 300 and the third member 400 may be caused by the second projection 320 of the second rotation member 300 abutting an opposite side of the projection 410 of the third member 400. This is clearly illustrated in FIG. 4B. The position at which the second rotation member 300 re-engages with the third member 400 corresponds to the first stop position of the first rotation member 200.

The rotation angle of the first rotation member 200 between the first and second stop positions is therefore the sum of the first and second predetermined rotation angles referred to above. In the example shown in FIGS. 3 and 4, this angle is approximately 600 degrees. Therefore, if the first rotation member 200 is configured such that its rotation directly actuates the position of a comb attachment 120 with respect to a hair cutting element 110, the first rotation member 200 can be used to accurately set the cutting length of the grooming device 100. This is described in the example below.

Referring to FIGS. 1 to 4, the first rotation member 200 may comprise a driving means such as a drive gear 220. The drive gear 220 is coupled to a driving mechanism, for example comprising the spindle 160 and spindle wheel 170, such that the drive gear 220 and driving mechanism are configured to actuate the comb attachment 120 when the first rotation member 200 is rotated. For example, the drive gear 220 and driving mechanism may be configured such that rotation of the first rotation member 200 in a first direction causes an increase in the distance between the comb attachment 120 and the cutting element 110 by moving the comb attachment 120 away from the cutting element 110. In a corresponding manner, the drive gear 220 and driving mechanism may be configured such that rotation of the first rotation member 200 in a second, opposite direction causes a decrease in the distance between the comb attachment 120 and the cutting element 110 by moving the comb attachment 120 closer to the cutting element 110.

It will be appreciated that, in an alternative configuration, the drive gear 220 and the associated driving mechanism could be configured to move the cutting element 110 rather than the comb attachment 120 to achieve the same variation in cutting length to that described above.

As shown in FIGS. 2A and 2B, the first rotation member 200 may comprise an outer part 230, an intermediate part 240 and the drive gear 220. All three parts 220, 230, 240 are fixed relative to each other such that they rotate together about the same axis of rotation. The outer part 230 may have a substantially cylindrical shape, with a grip element 231 provided at its outwardly facing circumferential surface. The grip element 231 is configured to allow a user to easily rotate the first rotation member 200 between the first and second stop positions. For example, the grip element 231 may comprise a layer of high friction material such as rubber.

The intermediate part 240 may also have a substantially cylindrical shape. It may be located substantially concentrically inwardly from the outer part 230 such that an outwardly facing circumferential surface of the intermediate part 240 is in contact with an inwardly facing circumferential surface of the outer part 230. This allows the inwardly facing circumferential surface of the outer part 230 to be fixed to the outwardly facing circumferential surface of the intermediate part 240, for example using suitable adhesive. As shown in FIG. 2A, projections on the inwardly facing surface of the outer part 230 may extend into correspondingly shaped depressions in the outwardly facing surface of the intermediate part 240 to provide a more secure fixing. It will be appreciated that projections on the outwardly facing circumferential surface of the intermediate part 240 may additionally or alternatively extend into corresponding depressions on the inwardly facing circumferential surface of the outer part 230.

As with the outer and intermediate parts 230, 240, the drive gear 220 may have substantially cylindrical or ring-like shape. As shown in FIGS. 2 to 4, it has a ring of driving teeth configured to cooperate with the driving mechanism to actuate the comb attachment 120. The drive gear 220 may be located substantially concentrically inwardly from the intermediate and outer parts 240, 230 such that an outwardly facing surface of the drive gear 220 can be fixed to an inwardly facing surface of the intermediate part 240. The fixing can be achieved using a suitable adhesive. As described above in relation to the fixing between the outer and intermediate parts 230, 240, projections extending into correspondingly shaped depressions may be employed to provide a more secure fixing.

It will be appreciated that although the outer part 230, intermediate part 240 and drive gear 220 of the first rotation member 200 are described herein as three separate elements, they may alternatively be two elements or a single element. The outer part 230, intermediate part 240 and drive gear 220 may therefore simply correspond to outer, intermediate and inner regions of the first rotation member 200.

As with the first rotation member 200, the second rotation member 300 may be substantially cylindrical in form. This is clearly shown in FIG. 2B. However, as shown in the Figures, it is not essential that the second rotation member 300 has a significant depth compared to its circumference, and so it may alternatively be described as being ring shaped. The rotational centre of the second rotation member 300 may be located axially with the rotational centre of the first rotation member 200.

Referring again to FIGS. 2A and 2B, the third member 400 may comprise a substantially cylindrical section of the main body of the grooming device 100. It may, for example, be coupled to the sub frame 150 of the grooming device 100. The centre of an end radial surface of the third member 400 may be located axially with the rotational centre of the first and second rotation members 200, 300.

Figures 5A, 5B:
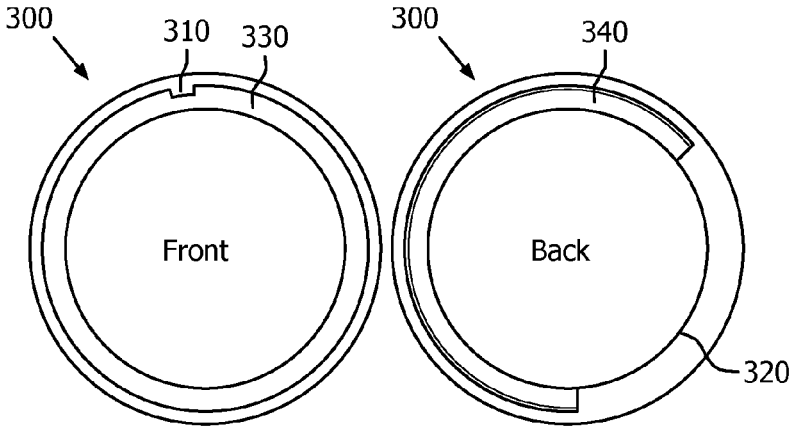
FIG. 5A is an illustration of a first radial surface of the second rotation member. The surface comprises a projection which extends substantially perpendicularly to the radial surface, and an arcuate recess configured to accommodate a projection extending from a radial surface of the first rotation member.
FIG. 5B is an illustration of a second radial surface of the second rotation member. The surface comprises a projection which extends substantially perpendicularly to the radial surface, and an arcuate recess configured to accommodate an end stop extending from a radial surface of a third member.

As referred to above and shown in FIGS. 2A, 3, 4A and 4B, the first rotation member 200 comprises a projection 210. The projection 210 extends in an axial direction from a radial surface of the first rotation member 200 towards a first radial surface of the second rotation member 300, which faces the radial surface of the first rotation member 200 and is substantially parallel to it. The first radial surface of the second rotation member 300 is shown in FIG. 5A. In the Figures, the projection 210 is shown as extending from the drive gear 220 part of the first rotation member 200. However, the projection 210 may alternatively extend from either of the outer part 230 or intermediate part 240 of the first rotation member 200.

The projection 210 of the first rotation member 200 is accommodated in an arcuate recess 330 of the first radial surface of the second rotation member 300 and can move along the recess 330 to allow relative rotation of the first rotation member 200 and the second rotation member 300 in the first rotation stage referred to above. However, movement of the projection 210 with respect to the second rotation member 300 is restricted by a first projection 310 of the second rotation member 300. As shown in FIGS. 3 to 5, the first projection 310 of the second rotation member 300 extends in an axial direction from the first radial surface of the second rotation member 300 towards the radial surface of the first rotation member 200. The first projection 310 of the second rotation member 300 is accommodated in an arcuate recess 250 of the radial surface of the first rotation member 200 along which it can move during the first rotation stage to allow relative rotation of the first and second rotation members 200, 300.

As briefly explained in the overview above, upon being rotated through a first predetermined rotation angle, the projection 210 of the first rotation member 200 reaches the end of the arcuate recess 330 in the first radial surface of the second rotation member 300 and abuts the first projection 310 of the second rotation member 300 to drive a rotation of the second rotation member 300 through a second predetermined rotation angle.

A second (opposite) radial surface of the second rotation member 300 is shown in FIG. 5B. It is also shown in cooperation with the third member 400 in FIG. 4B. The second radial surface of the second rotation member 300 is substantially parallel to first radial surface of the second rotation member 300 and the radial surface of the first rotation member 200. As can be seen, the second radial surface of the second rotation member 300 comprises a second projection 320, which extends in an axial direction away from the second radial surface of the second rotation member 300 towards a radial surface of the third member 400. The radial surface of the third member 400 is substantially parallel to the radial surface of the first rotation member 200 and the first and second radial surfaces of the second rotation member 300.

The second projection 320 of the second rotation member 300 is accommodated in an arcuate recess 420 in the radial surface of the third member 400 and can move along the recess 420 to allow the second rotation member 300 to rotate with respect to the third member 400 in the second rotation stage referred to above. The third member 400 is not rotatable, and may be fixed relative to a main body of the grooming device 100 as previously described. Movement of the second projection 320 with respect to the third member 400 is restricted by a projection 410 of the third member 400. As shown in FIG. 4B, the projection 410 of the third member 400 extends in an axial direction from the radial surface of the third member 400 towards the second radial surface of the second rotation member 300.

The projection 410 of the third member 400 is accommodated in an arcuate recess 340 in the second radial surface of the second rotation member 300 along which it can move during the second rotation stage to allow the second rotation member 300 to rotate with respect to the third member 400.

As previously discussed, upon the second rotation member 300 being rotated with the first rotation member 200 through a second predetermined rotation angle, the second projection 320 of the second rotation member 300 reaches the end of the arcuate recess 420 in the third member 400 and abuts the projection 410 of the third member 400. As the third member 400 is not rotatable, the abutment of the second projection 320 of the second rotation member 300 with the projection 410 of the third member 400 prevents further rotation of both the first and second rotation members 200, 300. The projection 410 of the third member 400 therefore comprises an end stop, which provides the first and second stop positions of the first rotation member 200.

An alternative solution to providing an adjustment wheel rotatable through an angle exceeding 360 degrees between first and second stop positions is to provide end stops on the spindle wheel 170 to restrict longitudinal movement of the spindle 160 rather than rotation of the wheel. The invention provides an advantage over this solution in that the end stop 410 is more robust, and less prone to damage when the adjustment wheel 100 is over-rotated.

Although the apparatus is described herein in terms of adjusting the distance between a comb attachment and a cutting element in a grooming device, the apparatus could alternatively be used for adjusting the distance between first and second elements of any kind, and is therefore not limited to use in grooming devices. E.g. the adjustment apparatus according to the current invention may be implemented in an element preventing an excess amount of rotation. Such an implementation could be beneficial in the limitation of the rotation of a screw or bolt preventing damage to soft materials or damage from overturning a bolt or screw. Another example of an alternative use of the adjusting apparatus according to the invention is the limitation of the travelling distance of a rolling device such a guiding wheel of a drawer running in a guiding groove limiting the rotation of the guiding wheel to a certain amount of degrees, thus to a corresponding travelling distance. Such an implementation could be beneficial in preventing the drawer to run out of its guiding groove during opening, causing a potentially dangerous situation to the user as well as an unpleasant mess to be cleaned by the user. The person skilled in the art will appreciate the wide applicability of the current invention in both domestic and industrial apparatuses. Furthermore, although the apparatus has been described in terms of first and second rotation members 200, 300, it will be appreciated that further rotation members could be incorporated between the second rotation member and the third member to increase the rotation angle between the first and second stop positions of the first rotation member. For example, a third rotation member having first and second radial surfaces corresponding to the first and second radial surfaces of the second rotation member 300 could be employed between the second rotation member 300 and the third member to increase the maximum rotation angle of the first rotation member.

While the invention has been illustrated and described in detail in the drawings and foregoing description, such illustration and description are to be considered illustrative or exemplary and not restrictive; the invention is not limited to the disclosed embodiments.

Other variations to the disclosed embodiments can be understood and effected by those skilled in the art in practicing the claimed invention, from a study of the drawings, the disclosure, and the appended claims. In the claims, the word "comprising" does not exclude other elements or steps, and the indefinite article "a" or "an" does not exclude a plurality. The mere fact that certain measures are recited in mutually different dependent claims does not indicate that a combination of these measures cannot be used to an advantage. Any reference signs in the claims should not be construed as limiting the scope.

The invention claimed is:

1. A grooming device comprising first and second elements and an adjustment apparatus for adjusting a distance between said first and second elements, said adjustment apparatus comprising:

a first rotation member arranged for rotation about an axis;

a second rotation member coaxially arranged with the first rotation member for mutual rotation relative to each other about said axis; and at least one end stop positioned for determining a range of rotation of the first and second rotation members, said range of rotation extending from a first stop position to a second stop position;

said first and second rotation members being adapted to cooperate with the at least one end stop such that:

rotation of the first rotation member away from the first stop position in a first direction will lead to engagement with and driving of the second rotation member until rotation of both the first and second members is stopped at the second stop position by the at least one end stop; and rotation of the first rotation member away from the second stop position in a second direction opposite to the first direction will lead to re-engagement with and driving of the second rotation member until rotation of both the first and second members is stopped at the first stop position by the at least one end stop;

said first rotation member being adapted for coupling to at least one of the first and second elements to adjust said distance in response to rotary motion of said first rotation member.

2. An adjustment apparatus according to claim 1 where the at least one end stop comprises a single end stop arranged for limiting the angular range of rotation of the second rotation member in both the first and second directions.

3. An adjustment apparatus according to claim 1 where the first and second rotation members comprise respective radially extending projections configured to mutually effect the engagement and re-engagement of said first and second rotation members.

4. An adjustment apparatus according to claim 3 where the radially extending projection of the first rotation member is configured to extend into anarcuate recess of the second rotation member.

5. An adjustment apparatus according to claim 1, further comprising a third member configured to engage with the second rotation member upon the second rotation member being rotated through the second rotation angle to prevent further rotation of the first and second rotation members.

6. An adjustment apparatus according to claim 5, wherein the third member comprises an end stop comprising an axially extending projection configured to abut a second axially extending projection of the second rotation member to engage the third member with the second rotation member to prevent further rotation of the first and second rotation members.

7. An adjustment apparatus according to claim 6, wherein the second axially extending projection of the second rotation member is configured to extend into an arcuate recess of the third member along which it is configured to move during the first rotation stage.

8. An adjustment apparatus according to claim 1, wherein the first rotation member comprises an outer grip for rotating the first rotation member in the first and second rotation stages.

9. An adjustment apparatus according to claim 1 where the range of rotation of the first rotation member in each of the first and second directions exceeds 360 degrees.

10. An adjustment apparatus according to claim 1 where the first rotation member is configured to move the first element with respect to the second element when said first rotation member is rotated.

11. An adjustment apparatus according to claim 10 where the first and second elements comprise a comb attachment and a hair cutting element, respectively.

12. A grooming device comprising a comb element, a hair cutting element, and an adjustment apparatus for adjusting a distance between said comb element and said hair cutting element, said adjustment apparatus comprising:

a first rotation member arranged for rotation about an axis;

a drive mechanism coupled to the first rotation member and to at least one of the comb element and the hair cutting element for adjusting the distance between said elements in response to rotatory movement of the first rotation member;

a second rotation member coaxially arranged with the first rotation member for mutual rotation relative to each other about said axis; and at least one end stop positioned for determining a range of rotation of the first and second rotation members, said range of rotation extending from a first stop position to a second stop position;

said first and second rotation members being adapted to cooperate with the at least one end stop such that;

rotation of the first rotation member away from the first stop position in a first direction will lead to engagement with and driving of the second rotation member until rotation of both the first and second members is stopped at the second stop position by the at least one end stop; and rotation of the first rotation member away from the second stop position in a second direction opposite to the first direction will lead to re-engagement with and driving of the second rotation member until rotation of both the first and second members is stopped at the first stop position by the at least one end stop.

13. A grooming device according to claim 12, wherein the first stop position corresponds to a minimum hair cutting length setting and the second stop position corresponds to a maximum hair cutting length setting.

14. A method of adjusting a distance between first and second elements of a grooming device over a range corresponding to a range of rotation of the first and second coaxially, arranged rotation members, said range of rotation being determined by at least one end stop and extending angularly from a first stop position to a second stop position said method comprising:

moving the first element relative to the second element in a first direction by rotating the first rotation member away from the first stop position in a first direction to lead to engagement with and driving of the second rotation member until rotation of both the first and second rotation members is stopped at the second stop position by the at least one end stop; and moving the first element relative to the second element in a second direction by rotating the first rotation member away from the second stop position in a second direction to lead to re-engagement with and driving of the second rotation member until rotation of both the first and second rotation members is stopped at the first stop position by the at least one end stop.

15. A method according to claim 14, wherein the second rotation member engages with a third member upon being rotated through the second rotation angle, the engagement between the second rotation member and the third member preventing further rotation of the first and second rotation members.

* * * * *